US006661309B2

(12) United States Patent
Chen et al.

(10) Patent No.: US 6,661,309 B2
(45) Date of Patent: Dec. 9, 2003

(54) MULTIPLE-CHANNEL FEED NETWORK

(75) Inventors: Ming Hui Chen, Ranchos Palos Verdes, CA (US); Rong-Chan Hsieh, Taipei (TW); Wei-Tse Cheng, Tainan Hsien (TW)

(73) Assignee: Victory Industrial Corporation, Taipei (TW)

( * ) Notice: Subject to any disclaimer, the term of this patent is extended or adjusted under 35 U.S.C. 154(b) by 53 days.

(21) Appl. No.: 10/039,545

(22) Filed: Oct. 22, 2001

(65) Prior Publication Data

US 2003/0076193 A1 Apr. 24, 2003

(51) Int. Cl.[7] ..... H01P 5/12
(52) U.S. Cl. ..... 333/126; 333/135; 333/21 A
(58) Field of Search ..... 333/125, 135, 333/21 A, 21 R, 126, 137

(56) References Cited

U.S. PATENT DOCUMENTS

| | | | | | |
|---|---|---|---|---|---|
| 3,922,621 | A | * | 11/1975 | Gruner | 333/21 R |
| 4,228,410 | A | * | 10/1980 | Goudey et al. | 333/122 |
| 4,319,206 | A | * | 3/1982 | Schuegraf | 333/126 |
| 4,622,524 | A | * | 11/1986 | Morz | 333/126 |
| 5,739,734 | A | | 4/1998 | Chen et al. | 332/210 |
| 6,031,434 | A | * | 2/2000 | Tatomir et al. | 333/126 |
| 6,060,961 | A | | 5/2000 | Moheb | 333/126 |
| 6,166,699 | A | * | 12/2000 | Khammouni et al. | 343/756 |
| 6,417,815 | B2 | * | 7/2002 | Moheb | 343/772 |

FOREIGN PATENT DOCUMENTS

WO WO 01/65642 A2 9/2001

* cited by examiner

*Primary Examiner*—Robert Pascal
*Assistant Examiner*—Dean Takaoka
(74) *Attorney, Agent, or Firm*—Fliesler Dubb Meyer & Lovejoy LLP

(57) ABSTRACT

A multi-channel feed network includes a main waveguide section (either square or circular) for connection to a satellite antenna for propagating two orthogonal polarizations. The feed network further includes a low pass section connected on axis with the main waveguide, the low pass section having the same cross section as the main waveguide, and a high pass section also connected perpendicular to the main waveguide. The low pass section includes a band reject filter (BRF) formed from slots cut to reject higher frequency signals. The high pass section can be a rectangular waveguide which functions to filter low frequency signals. The feed network can be configured to support a number of different polarizations. Orthogonal linear polarizations are provided for the high frequency bands by adding additional high pass sections connected by power dividers, and for the low frequency bands by adding a conventional OMT. Adding a polarizer between the antenna and main waveguide section enables both the high pass and low pass sections to support left or right hand circular polarization. By adding a 90° degree hybrid coupler, the high pass section can support circular polarization alone. By adding a polarizer and OMT after the low pass section, the low pass section can support circular polarization alone. By using two 90° degree hybrid couplers and two power dividers, a network can be created to support dual circular or linear polarizations.

12 Claims, 13 Drawing Sheets

MULTIPLE-CHANNEL FEED NETWORK

BACKGROUND OF THE INVENTION

1. Field of the Invention

The present invention relates to a microwave waveguide feed network which has one port typically made of circular or square waveguide used to interface with an antenna, and additional ports for connection to one or more transmitters and/or receivers. More particularly, the present application relates to such microwave feed networks for use in satellite communications.

2. Background

A conventional feed network to transfer a microwave signal between an antenna and a transmitter and receiver is an ortho-mode transducer ("OMT"). The OMT is a three-port device, as shown in FIGS. 1A and 1B, which has a circular waveguide port 100 for interfacing with an antenna and two rectangular waveguide ports 102 and 104, each for connecting to a transmitter and/or a receiver. The OMT is often used to feed orthogonal polarizations at ports 102 and 104 to and from the port 100 connected to an antenna used in satellite communications. The two orthogonal polarizations provided at ports 102 and 104 may cover the same or different frequencies.

As the demand for wireless communications increases, the transmission and receiving capacity of communication systems must also increase. Signals provided from a antenna must be provided to more than two ports, with each port potentially having different polarization requirements or different frequency ranges. In order to increase the capacity of a conventional OMT, network elements such as filters, switches and couplers have to be connected to rectangular waveguide ports of the OMT to distribute a signal between the circular waveguide antenna port to additional waveguide ports.

SUMMARY

The present invention provides a network with increased channel capacity over an OMT. The network in accordance with the present invention enables a system's capacity to be upgraded without the need for additional filters, switches or couplers needed to increase the number of ports available on a conventional OMT.

The multi-channel network in accordance with present invention further provides for transferring a signal between a waveguide connected to an antenna and additional ports with a variety of polarizations. For instance, the network can support linear, right hand or left hand circular, dual linear, or dual circular polarizations.

The multi-channel network in accordance with the present invention is further capable of being manufactured using low cost die casting.

The multi-channel network in accordance with the present invention includes a main waveguide section (either square or circular) for propagation of two orthogonal polarizations, an on-axis low pass section which has the same cross section as the main waveguide section, and a high pass section connected perpendicular to the main waveguide section. The low pass section includes a band reject filter (BRF) which is a modified version of a filter described in U.S. Pat. No. 5,739,734. Isolation between the low and high frequency waveguide channel sections is obtained by the rejection performance of the filters, including the BRF and the high pass waveguide section which functions as a filter. Limited disturbance to the cross polarized signals provided from the BRF occurs due to the geometric symmetry of the feed network.

The feed network can be configured to support a number of different polarizations. The feed network can provide two orthogonal linear polarizations for both high and low frequency bands. Orthogonal linear polarizations are provided for the high frequency bands by adding additional high pass sections connected by power dividers, while orthogonal linear polarizations are provided for low frequency bands by adding a conventional OMT. Adding a polarizer between the antenna and main waveguide section enables both the high pass and low pass sections to support left or right hand circular polarization. By adding a 90° degree hybrid coupler, the high pass section can support circular polarization alone. By adding a polarizer and OMT after the low pass section, the low pass section can support circular polarization. By using two 90° degree hybrid couplers and two power dividers, a network can be created to support dual circular polarization, or dual linear polarization.

BRIEF DESCRIPTION OF THE DRAWINGS

The present invention will be described with respect to particular embodiments thereof, and references will be made to the drawings in which.

DETAILED DESCRIPTION

Figure 1A:
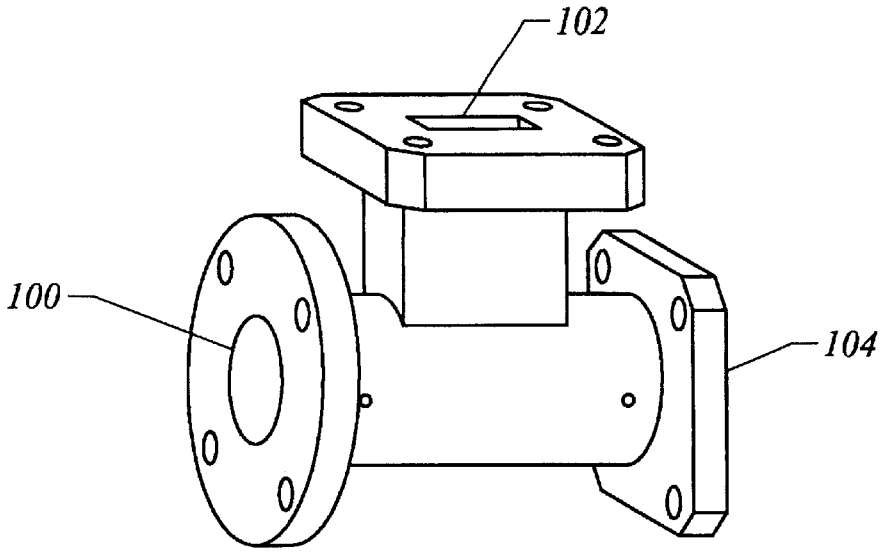
FIG. 1A (Prior Art)
FIGS. 1A and 1B show a perspective view of a conventional three-port OMT.
Figure 1B:
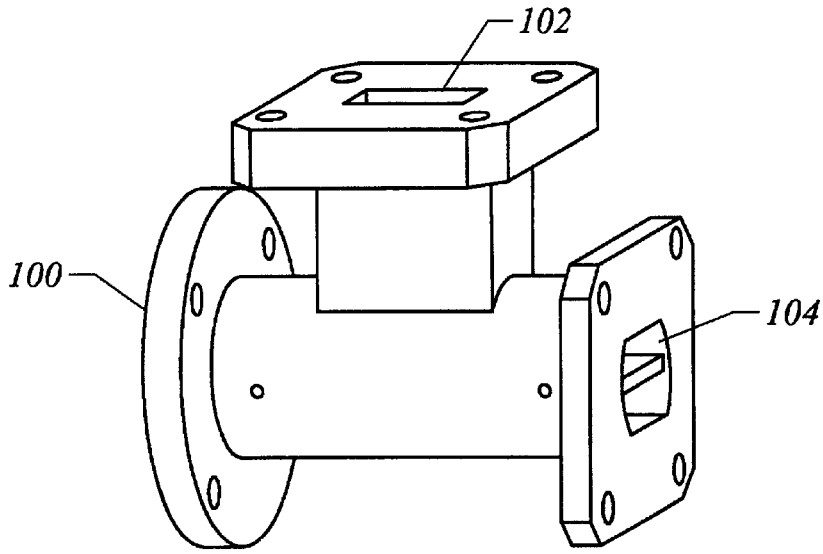
FIG. 1B (Prior Art)
Figure 2:
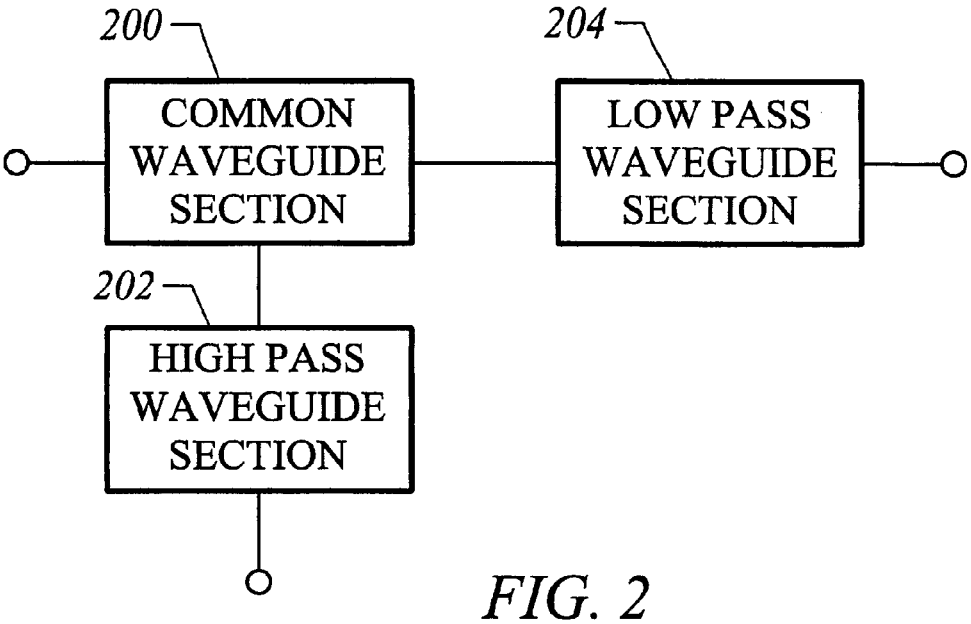
FIG. 2 shows a block diagram of a multi-channel feed network in accordance with the present invention.
Figure 3A:
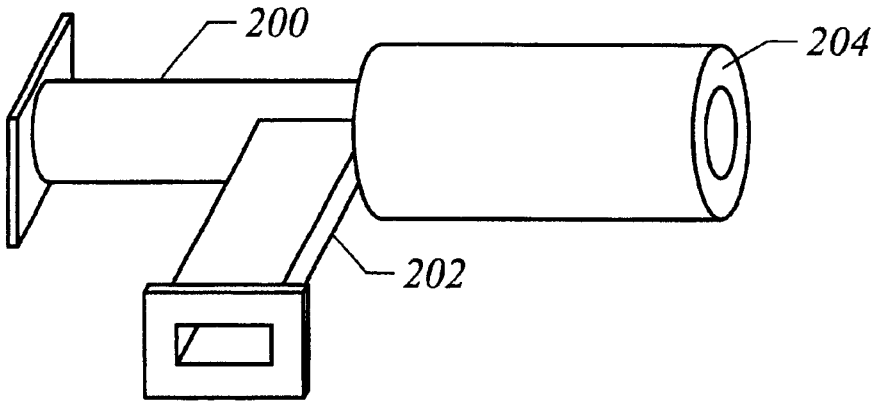
FIG. 3A shows a perspective view for one embodiment of the feed network depicted in FIG. 2.
Figure 3B:
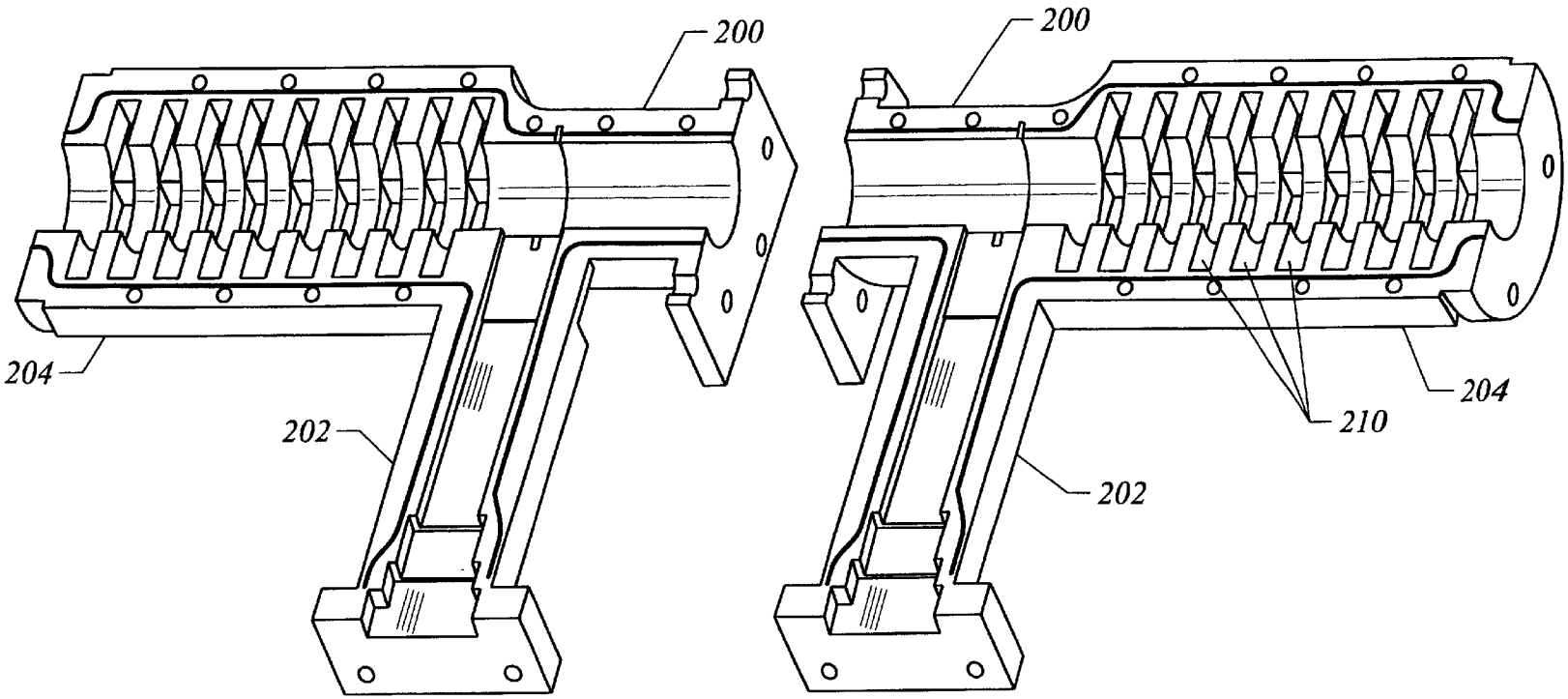
FIG. 3B shows cutaway perspective views of the feed network of FIG. 3A.

FIG. 2 shows a block diagram of a multi-channel feed network in accordance with the present invention. The multi-channel feed network includes a common waveguide section 200, a high pass section 202 and a on-axis low pass section 204. FIG. 3A shows a perspective view of one embodiment of the feed network depicted in FIG. 2. FIG. 3B shows perspective views of the feed network of FIG. 3A cut in half. For convenience, components of FIGS. 3A and 3B corresponding to those in FIG. 2 are similarly labeled, as will be components carried over in subsequent drawings.

The common waveguide section 200 represented in FIG. 2 can be circular or square or any cross section waveguide that can support two polarizations, or orthogonal propagating modes. The common section 200 shown in FIGS. 3A and 3B is a circular waveguide.

The high pass section 202 functions as a filter to low frequency signals, and serves as a channel path perpendicular to the path of the common waveguide section 200. By controlling the length of the high pass filter section 202, isolation to the low pass section 204 can be obtained. The perpendicular high pass channel 202 does not provide any significant deterioration to the cross polarization of the common waveguide section 200.

Figure 3C:
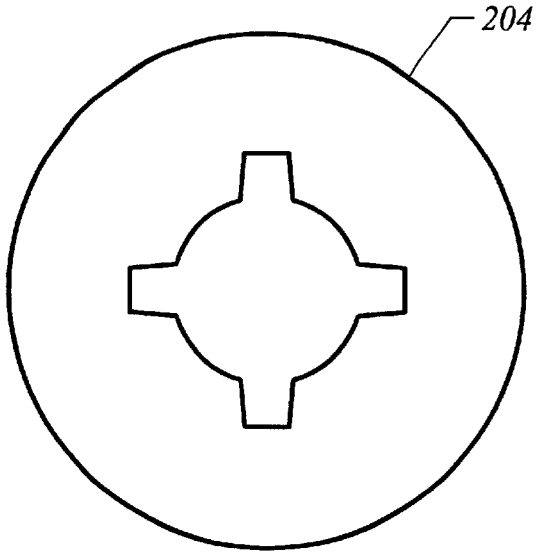
FIG. 3C shows a cross section of the low pass section of the feed network of FIG. 3A.

The low pass section 204, being on-axis with the common section 200, includes a band reject filter (BRF) that passes the low frequency band signals and rejects high frequency band signals. The cross section of the low pass section 204, as shown in FIG. 3C, has slots cut forming the band reject filter and is similar to the common waveguide section 200 apart from the slots 210. The slots for the band reject filter can be tapered to enable the network to be die cast and easily removed from a mold. The band reject filter is made of the evanescent mode filter cutouts along both an x-axis and a y-axis with geometric symmetry of the cutouts providing for both dual orthogonal polarizations. The symmetry of the band reject filter cutouts maintains the cross polarization of the entire feed network with limited degradation. The distance between the low pass section 204 and the high pass section 202 is important because the distance cause the band reject filter cutouts to act as either a short or an open as seen by the high pass channel 202. With the high pass section 202 manufactured as a rectangular waveguide as shown in FIGS. 3A and 3B, one polarization can be carried by the high frequency channel. The low pass section 204 shown in FIGS. 3A and 3B is circular, allowing for two orthogonal polarizations to be carried on the low frequency channel. The functions of the basic feed network shown in FIGS. 3A and 3B can be expanded as described in more detail below.

Figure 4:
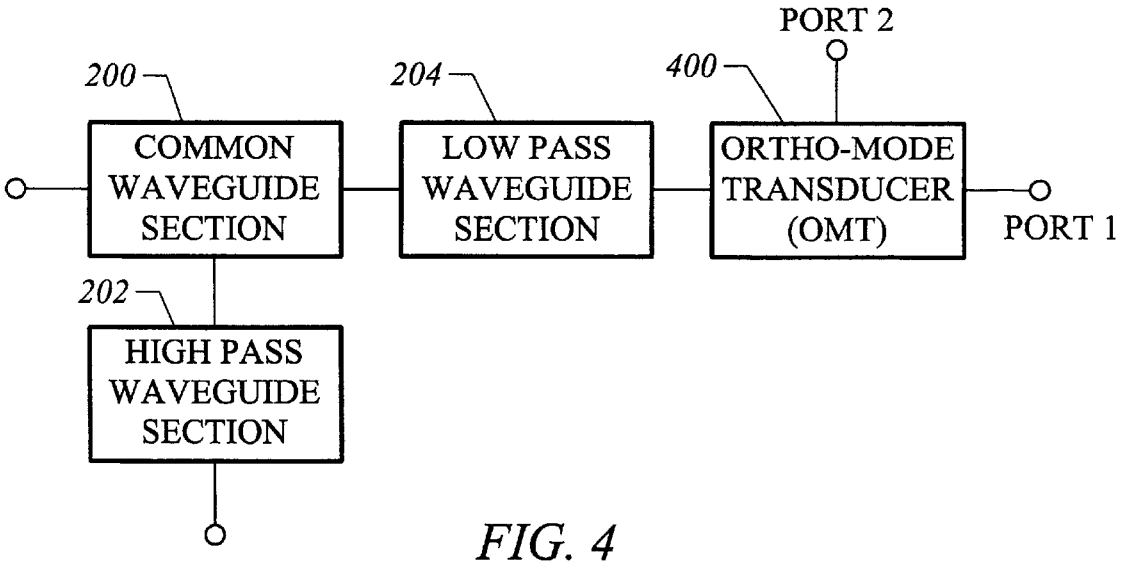
FIG. 4 shows a block diagram with a conventional OMT connected to the multi-channel feed network of FIG. 2.

If isolation of the cross polarization components of the low band pass section 204 is desired, a conventional OMT 400 can have its circular waveguide port attached to the circular port 214 of the low pass section 204, as shown in FIG. 4. The OMT will provide good isolation of the orthogonal signals as divided between the rectangular ports 1 and 2 of the OMT. Another advantage of attaching the OMT as shown in FIG. 4, is that the rectangular ports 1 and 2 are more compatible with standard rectangular interfaces typically found on transmitters and receivers.

Figure 5:
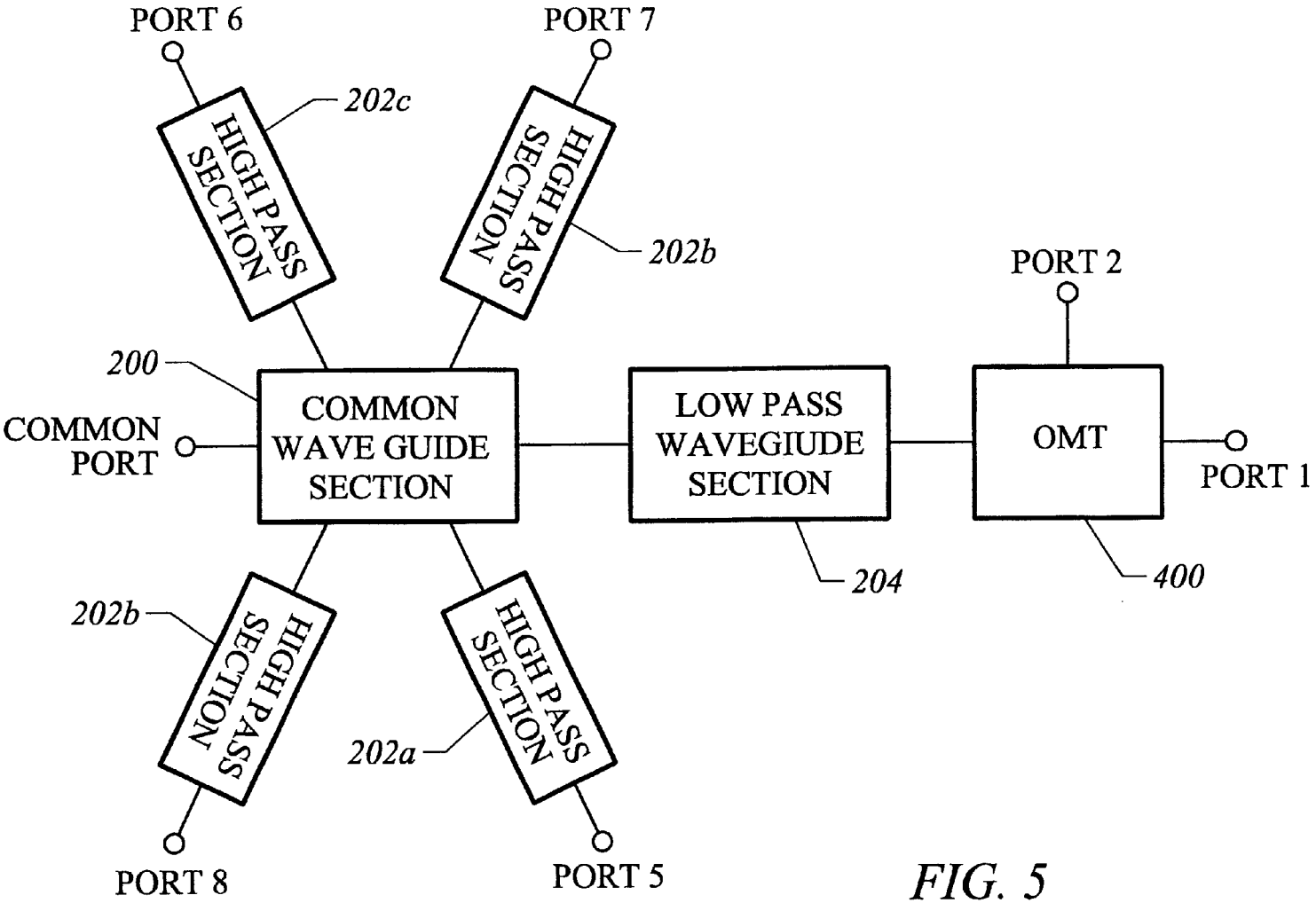
FIG. 5 shows a block diagram illustrating additional high pass ports added to the configuration of FIG. 4.
Figure 6:
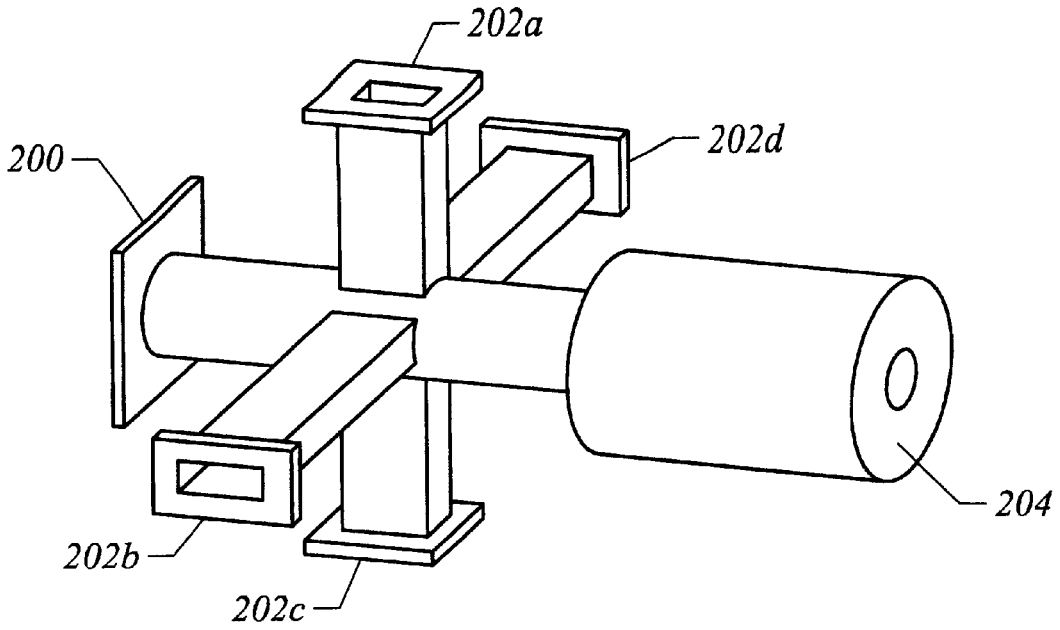
FIG. 6 shows a perspective view of the components of FIG. 5, apart from the OMT.

If additional high pass ports are desired, additional high pass sections 202*a*–202*d* can be added to the configuration of FIG. 4 to provide ports 5, 6, 7 and 8, as illustrated in FIG. 5. FIG. 6 shows a perspective view of a feed network of FIG. 5, similar to FIG. 3A, including a common section 200, a low pass section 204, and four orthogonal high pass sections 202*a*, 202*b*, 202*c* and 202*d* (as opposed to the single high pass section 202 of FIG. 3), and excluding the OMT 400 of FIG. 5.

Figure 7:
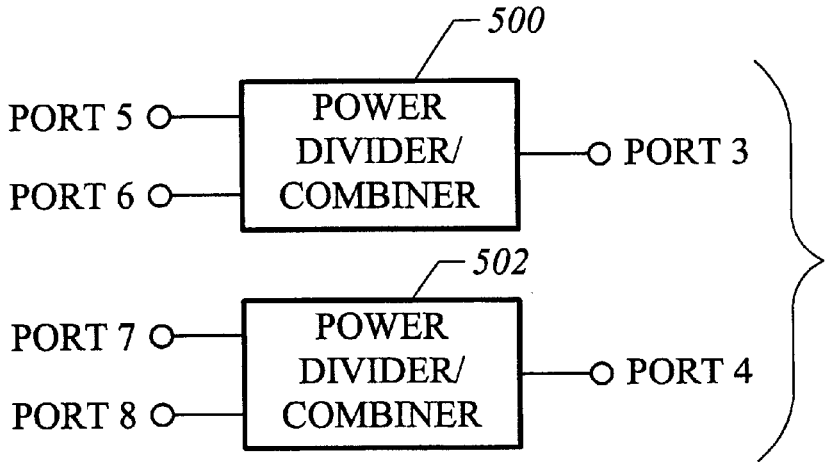
FIG. 7 shows two equal amplitude power dividers for connection to the additional high pass ports of FIG. 5 to enable two high pass outputs to be provided.

With the four high pass sections 202*a*–202*d* included, two equal amplitude power dividers/combiners 500 and 502, as shown in FIG. 7, can be connected to the high pass sections 202*a*–202*d* at ports 5–8 of FIG. 5, to create two high pass ports 3 and 4. Outputs of two of the high pass ports 5 and 6, or 7 and 8, spaced physically 180 degrees apart have signals combined by each of the respective power dividers 500 and 502 to include all modes making up one polarization of the original high pass signal. The geometric symmetries of the high pass sections 202*a*–202*d* and power dividers 500 and 502 make the electromagnetic mode or the signals provided at ports 3 and 4 extremely pure. Between the two high pass output ports 3 and 4, the cross polarization isolation will be high. The two high pass ports 3 and 4 can, thus, excite two orthogonal linear polarization waves in this feed network at high band. As described above, even with the four high pass sections 202*a*–202*d*, the two linear orthogonal polarizations provided from ports 1 and 2 of the low band section can still be included in the feed network.

Figure 8:
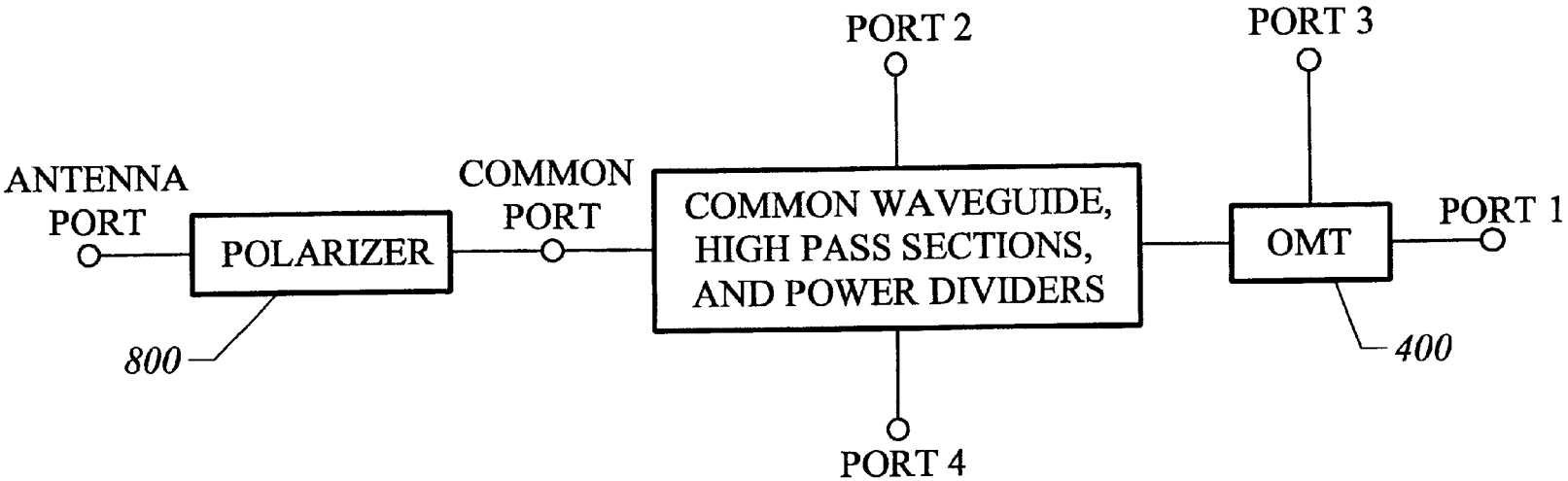
FIG. 8 shows the combined structures of FIGS. 5 and 7 with an additional polarizer added to enable supporting right hand and left hand circular polarization.

Both right hand circular polarization (RHCP) and left hand circular polarization (LHCP) can be supported by the structure of FIG. 5 with multiple high pass sections and power dividers of FIG. 7 connected with a polarizer 800, as illustrated in FIG. 8. The polarizer 800 is connected between an antenna and the common port of the common waveguide section 200, as illustrated in FIG. 8. For the low pass sections, when port 1 or 2 is selected to support right hand circular polarization, the other port automatically supports left hand circular polarization with the polarizer 800 attached. Similar concepts apply to provide right and left hand circular polarization signals from ports 3 and 4 of the high pass sections.

Figure 9:
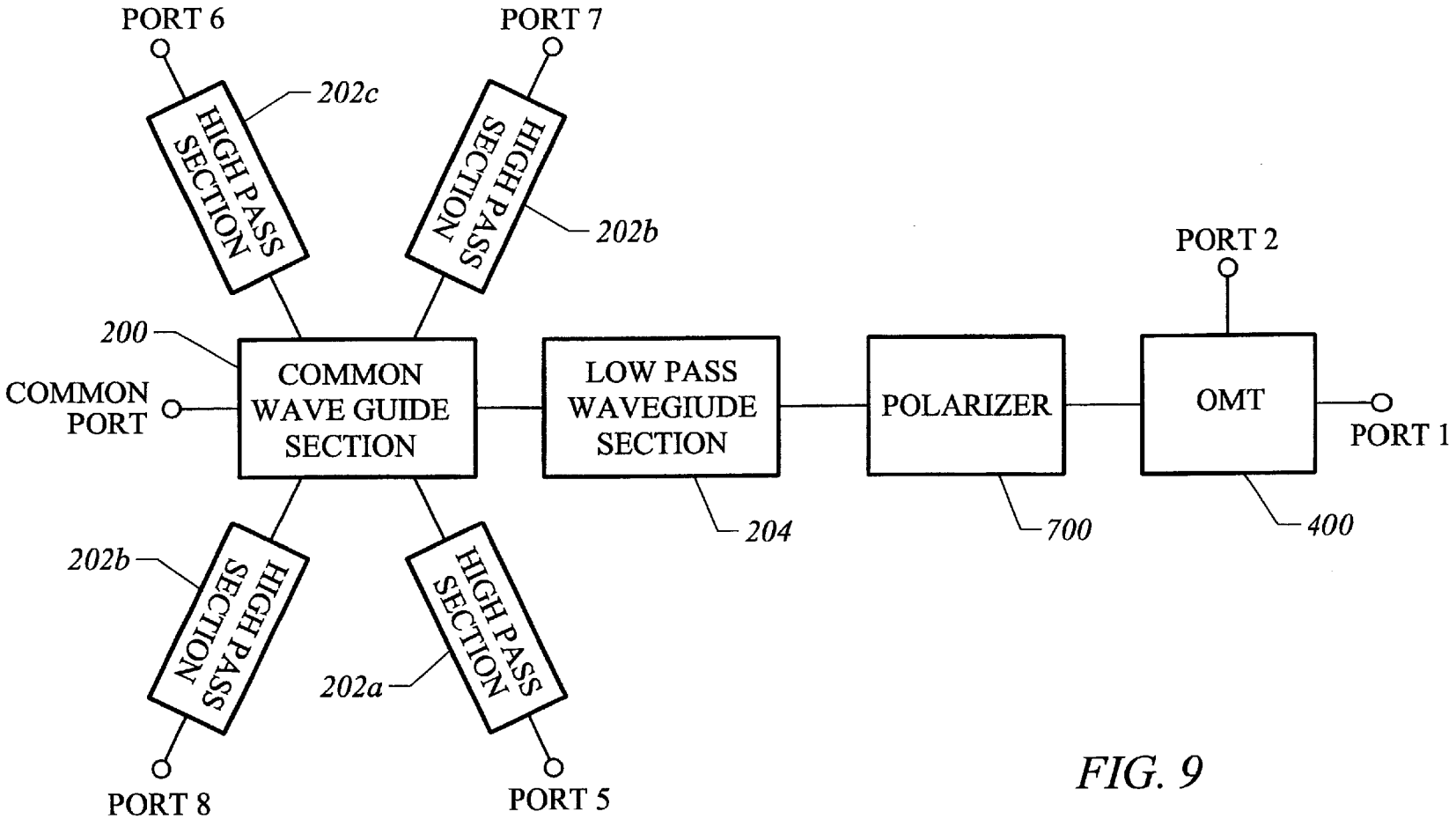
FIG. 9 shows the insertion of a polarizer 700 between the low pass section and the conventional OMT of the circuit of FIG. 5 enabling the low band to support circular polarization alone.
Figure 10:
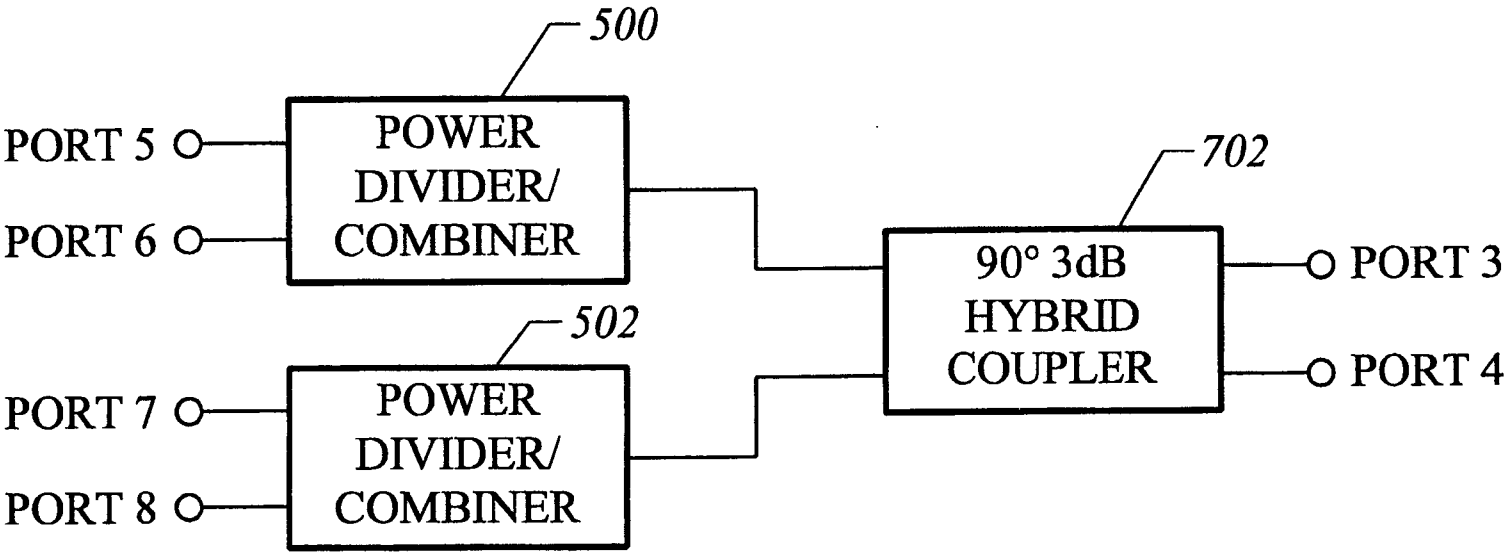
FIG. 10 shows additional components which may be connected to the high band sections of FIG. 9 to enable the high band to support circular polarization alone.

The low band and high band sections can also be individually polarized, as illustrated in FIGS. 9 and 10. As shown in FIG. 9, by inserting a polarizer 700 between the low pass section 204 and the conventional OMT 400 of the circuit of FIG. 5, the low band can be made to support circular polarization. By adding the components of FIG. 10 to the circuit of FIG. 9, circular polarization can be individually supported by the high band section. In FIG. 10, a 90° hybrid 3 dB coupler 702 is connected to the output of two power dividers 500 and 502 of FIG. 7 to form the ports 3 and 4, enabling the high band ports 3 and 4 to support circular polarization. If the network requires only one of the low band section or high band section to support circular polarization, either the polarizer 700 or the 90° degree 3 dB coupler 702 can be omitted from the system.

To maximize the performance of the conventional circular polarization feed network, the VSWR of the feed antenna must be exceedingly low. The need for a low VSWR results because a small amount of mismatch between the feed network and the antenna will cause reflections at the interface which will experience a change in polarization, i.e. From RHCP to LHCP and vice versa, resulting in multiple reflections in the attached feed network. But, an antenna with a higher VSWR due to an axial ratio mismatch can have an improved performance with the feed network in accordance with the present invention by terminating orthogonal ports with matched loads. For example, if an axially mismatched antenna is used and it is desired to transmit and receive using ports 1 and 4 of FIG. 8, improved performance can be obtained by terminating ports 1 and 4. Mismatch signals reflected from the feed antenna are then absorbed at ports 2 and 3, and the effects of higher VSWR due to an axial mismatch remains at a minimum. A similar method can be applied with the configurations illustrated by FIGS. 9 and 10.

The use of a discrete 90° hybrid 3dB couplers connecting to ports 3 and 4 can be achieved using coaxial connectors and phase-matched cables. However, the added cost of manufacturing separate components with connectors is a disadvantage. A lower cost less complex feed network can be achieved by manufacturing the entire feed network including the coupler and power dividers in a single plane that can be die cast as one unit at a low cost.

Figure 11:
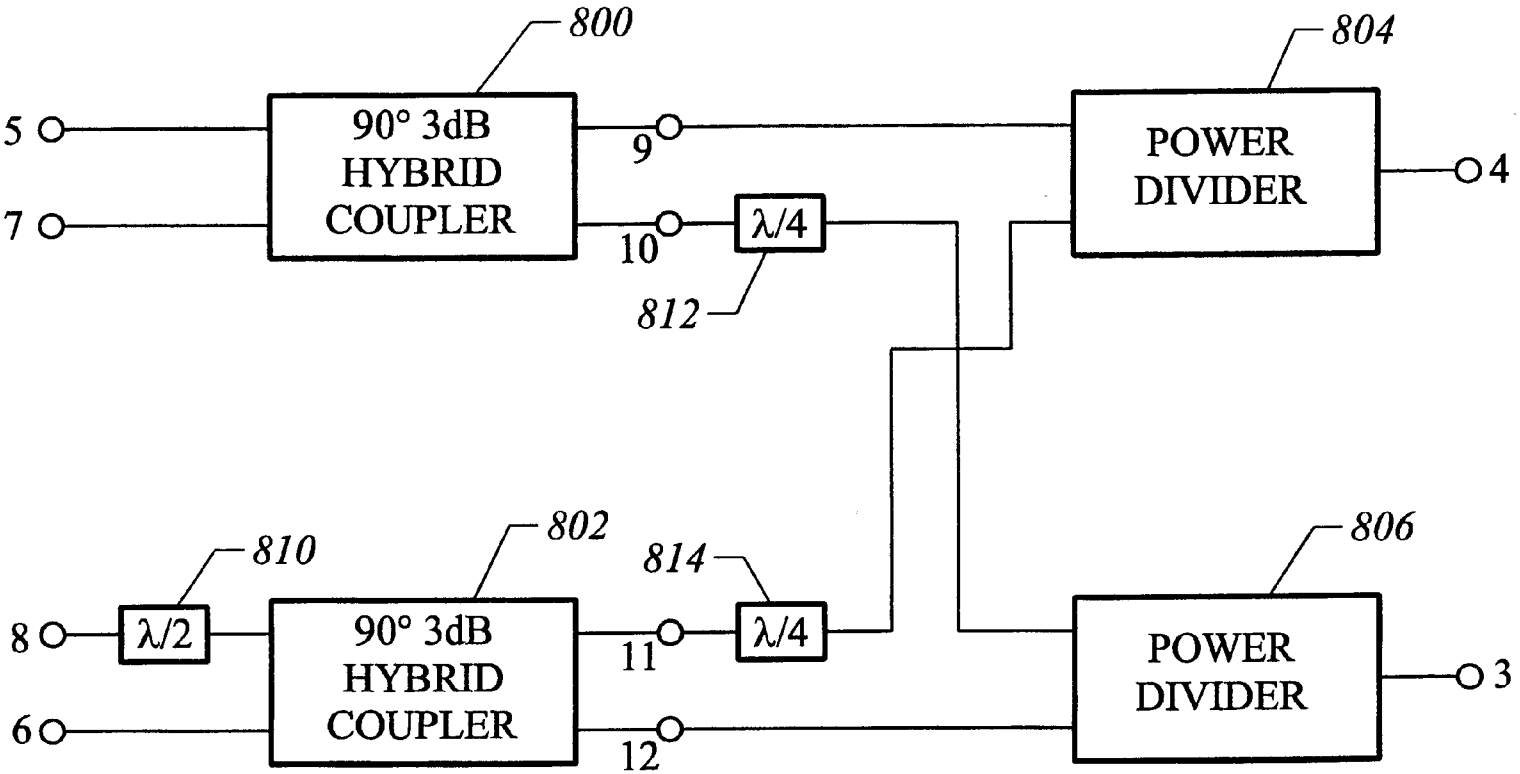
FIG. 11 shows a block diagram of additional components which can be connected to the high pass sections of FIG. 5 or FIG. 9 to enable the high pass sections to support dual circular polarizations.

FIG. 11 shows a block diagram of additional components which can be connected to ports 5, 6, 7 and 8 of the high pass sections of FIG. 5 or FIG. 9 to enable the feed network to provide dual circular polarizations. The additional components include two 90° 3 dB hybrid couplers 800 and 802 connected to the high pass waveguide ports 5, 6, 7 and 8, as shown. Port 8 is connected to the 90 degree coupler 802 by a ½ wavelength delay line 810. The remaining ports 5, 6 and 7 are connected with phase matched lines. The additional components further include power dividers 804 and 806 connected to the output ports, labeled 9, 10, 11 and 12 of the 90° hybrid couplers 800 and 802. Ports 10 and 1 1 of the couplers are connected to the respective power dividers 802 and 800 by ¼ wavelength delay lines 812 and 814. The ports 9 and 12 are connected using phase matched lines. The output ports 3 and 4 of the power dividers 804 and 806 provide the two orthogonal circular polarizations.

Figure 12:
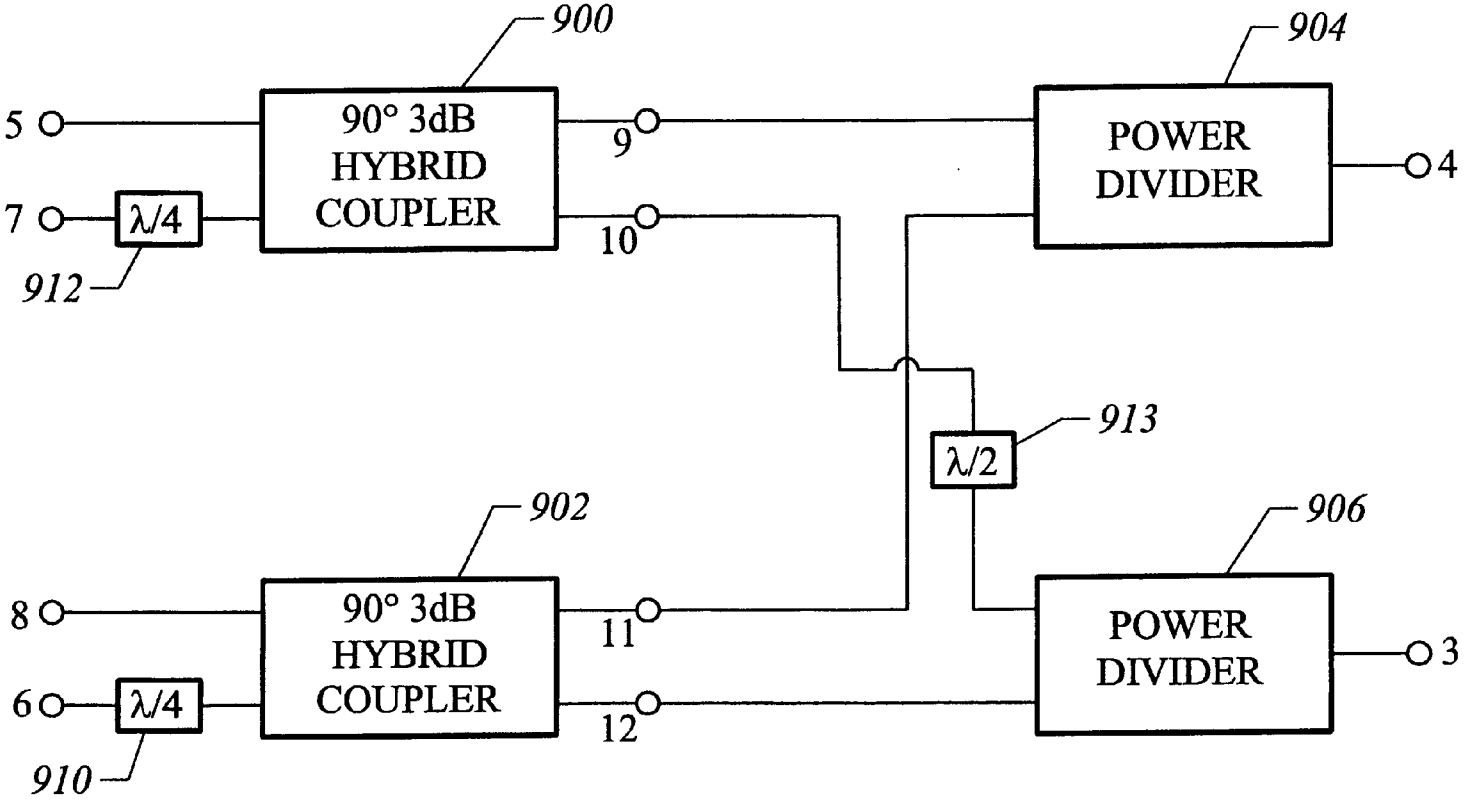
FIG. 12 shows a block diagram of additional components which can be connected to the high pass sections of FIG. 5 or FIG. 9 to enable the high pass sections to support dual linear polarizations.

FIG. 12 shows a block diagram of additional components which can be connected to ports 5, 6, 7 and 8 of the high pass sections of FIG. 5 or FIG. 9 to enable the feed network to provide dual linear polarizations. The additional components include two 90° 3 dB hybrid couplers 900 and 902 connected to the high pass waveguide ports 5, 6, 7 and 8, as shown. Ports 6 and 7 are connected to the couplers 900 and 902 using ¼ wavelength delay lines 910 and 912. The remaining ports 5 and 8 are connected with phase matched lines. The additional components further include power dividers 904 and 906 connected to the output ports, labeled 9, 10, 11 and 12 of the 90° 3 dB hybrid couplers 900 and 902. The port 10 is connected to the power divider 906 by a ½ wavelength delay line 913. The remaining ports 9, 11 and 12 are connected using phase matched lines. The output ports 3 and 4 of the power dividers 904 and 906 provide the two orthogonal linear polarizations.

Figure 13:
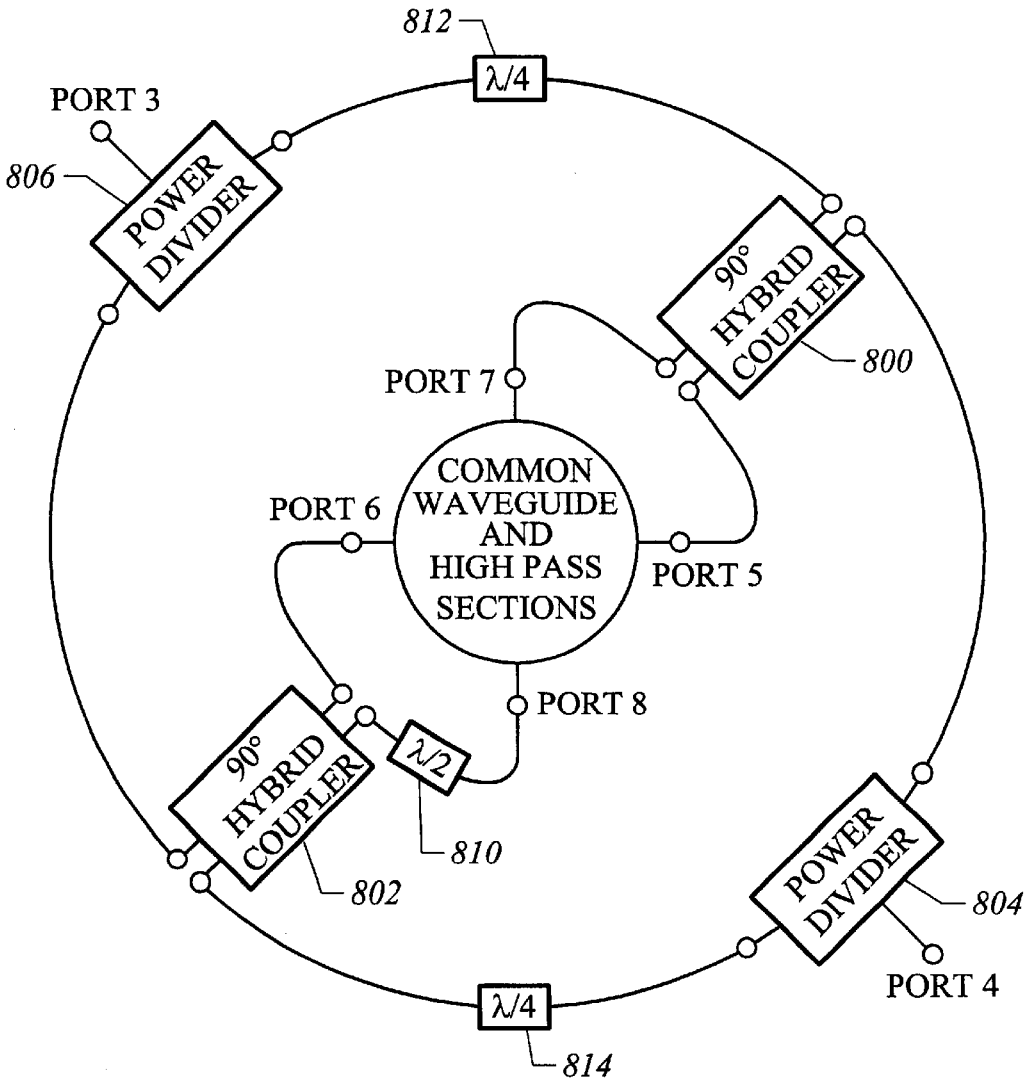
FIG. 13 shows the components of FIG. 11 in a configuration enabling die-casting of the components in a single plane.
Figure 14:
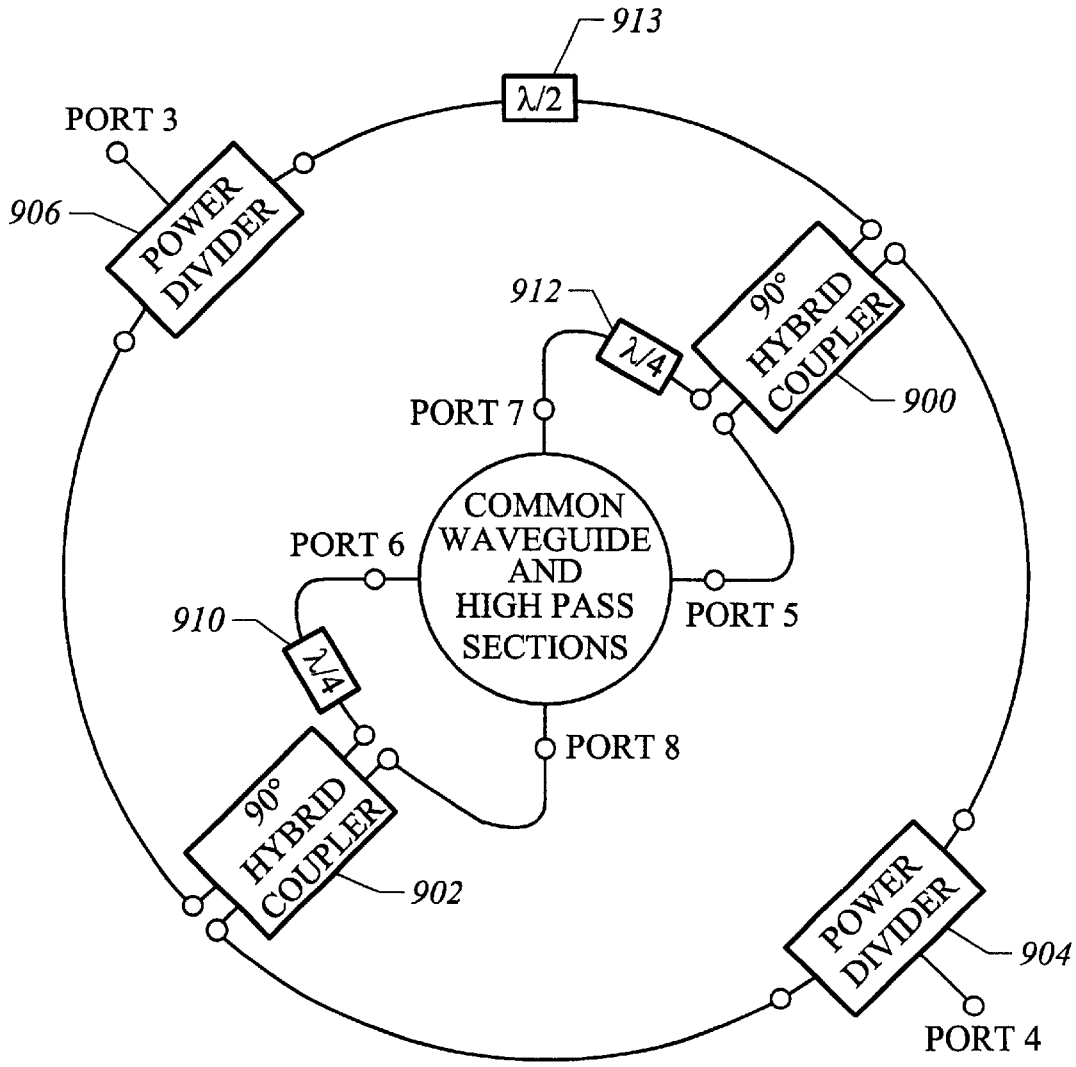
FIG. 14 shows the components of FIG. 12 in a configuration enabling die-casting of the components in a single plane.

The components in the block diagram of FIG. 11 in combination with a common waveguide section and high pass sections are shown connected in a configuration enabling die-casting of the components in a single plane in FIG. 13. The hybrid couplers 800 and 802 enable configuration of transmission lines without the transmission lines crossing, enabling the layout to be in a single plane. For example, a connection from port 7 to power divider 806 would cross a connection from port 5 to power divider 804, preventing construction of the network in a single plane without the hybrid couplers 800 and 802. Similarly, the components in the block diagrams of FIG. 12 in combination with a common waveguide section and high pass sections are shown connected in a configuration enabling die-casting of the components in a single plane in FIG. 14.

Although the present invention has been described above with particularity, this was merely to teach one of ordinary skill in the art how to make and use the invention. Many other modifications will fall within the scope of the invention, as that scope is defined by the claims provided to follow.

What is claimed is:

1. A multi-channel feed network comprising:

a common waveguide section;

a low pass waveguide section connected substantially on axis with the common waveguide section, the low pass waveguide section comprising:

waveguide having a cross section substantially matching a cross section of the common waveguide section;

a band reject filter formed with slots in the waveguide of the low pass waveguide section;

a first high pass waveguide section connected at substantially a perpendicular angle with the common waveguide section;

a second high pass waveguide section connected at substantially a perpendicular angle with the common waveguide section, and substantially a 90-degree angle with the first high pass waveguide section;

a third high pass waveguide section connected at substantially a perpendicular angle with the common waveguide section, and substantially a 90-degree angle with the second high pass wave guide section;

a fourth high pass waveguide section connected at substantially a perpendicular angle with the common waveguide section, and substantially a 90-degree angle with the third high pass wave guide section;

a first power divider having a first terminal for connecting to the first high pass waveguide section, a second terminal for connecting to the third high pass section, and a third terminal; and a second power divider having a first terminal for connecting to the second high pass waveguide section, a second terminal for connecting to the fourth high pass section, and a third terminal.

2. The multi-channel feed network of claim 1, further comprising:

a 90° hybrid coupler having a first terminal coupled to the third terminal of the first power divider, a second terminal coupled to the third terminal of the second power divider, a third terminal and a fourth terminal.

3. The multi-channel feed network of claim 1, wherein the common waveguide section comprises a circular waveguide, wherein the low pass waveguide section comprises a circular waveguide, and wherein the first, second, third and fourth high pass waveguide sections comprise a rectangular waveguide.

4. The multi-channel feed network of claim 1, further comprising:

an orthogonal mode transducer having a common terminal coupled to the low pass waveguide section, and two additional terminals.

5. The multi-channel feed network of claim 4, further comprising:

a polarizer coupling the low pass waveguide section to the orthogonal mode transducer.

6. The multi-channel feed network of claim 4, further comprising:

a first termination connected to one of the two additional terminals of the orthogonal mode transducer; and a second termination connected to one of the third terminals of the first power divider and the second power divider.

7. The multi-channel feed network of claim 4, further comprising:

a 90° hybrid coupler having a first terminal coupled to the third terminal of the first power divider, a second terminal coupled to the third terminal of the second power divider, a third terminal and a fourth terminal.

8. The multi-channel feed network of claim 4, further comprising:

a polarizer having a first terminal connected to the common waveguide section and a second terminal for connecting to an antenna.

9. A multi-channel feed network comprising:

a common waveguide section;

a low pass waveguide section connected substantially on axis with the common waveguide section, the low pass waveguide section comprising:

waveguide having a cross section substantially matching a cross section of the common waveguide section;

a band reject filter formed with slots in the waveguide of the low pass waveguide section;

a first high pass waveguide section connected at substantially a perpendicular angle with the common waveguide section;

a second high pass waveguide section connected at substantially a perpendicular angle with the common waveguide section, and substantially a 90-degree angle with the first high pass waveguide section;

a third high pass waveguide section connected at substantially a perpendicular angle with the common waveguide section, and substantially a 90-degree angle with the second high pass wave guide section;

a fourth high pass waveguide section connected at substantially a perpendicular angle with the common waveguide section, and substantially a 90-degree angle with the third high pass wave guide section;

a first 90° hybrid coupler having a first terminal connected to the first high pass waveguide section, a second terminal connected to third high pass waveguide section, and having a third terminal and a fourth terminal;

a second 90° hybrid coupler having a first terminal connected to the second high pass waveguide section, a second terminal connected to the fourth high pass waveguide section, and having a third terminal and a fourth terminal;

a first power divider having a first terminal connected to the third terminal of the first 90° hybrid coupler, a second terminal connected to the third terminal of the second 90° hybrid coupler, and having a third terminal; and a second power divider having a first terminal connected to the fourth terminal of the first 90° hybrid coupler, a second terminal connected to the fourth terminal of the second 90° hybrid coupler, and having a third terminal.

10. The multi-channel feed network of claim 9, further comprising:

a ½ wavelength section connecting the fourth high pass waveguide section to the second 90° hybrid coupler;

a first ¼ wavelength section connecting the fourth terminal of the first 90° hybrid coupler to the first terminal of the second power divider; and a second ¼ wavelength section connecting the third terminal of the second 90° hybrid coupler to the second terminal of the first power divider.

11. The multi-channel feed network of claim 9, further comprising:

a first ¼ wavelength section connecting the second high pass waveguide section to the second terminal of the second 90° hybrid coupler; and a second ¼ wavelength section connecting the third high pass waveguide section to the second terminal of the first 90° hybrid coupler.

12. The multi-channel feed network of claim 11, manufactured using die casting.

* * * * *